US006658665B2

(12) United States Patent
Dodge

(10) Patent No.: US 6,658,665 B2
(45) Date of Patent: Dec. 9, 2003

(54) DISPOSABLE RAINWEAR

(76) Inventor: Geoffrey L. Dodge, 207 Kitchawan Rd., South Salem, NY (US) 10590

( * ) Notice: Subject to any disclaimer, the term of this patent is extended or adjusted under 35 U.S.C. 154(b) by 0 days.

(21) Appl. No.: 09/939,270

(22) Filed: Aug. 24, 2001

(65) Prior Publication Data

US 2003/0037362 A1 Feb. 27, 2003

(51) Int. Cl.[7] ..... A41D 3/04
(52) U.S. Cl. ..... 2/87; 2/84
(58) Field of Search ..... 2/87, 88, 69, 69.5, 2/85, 89, 92, 94

(56) References Cited

U.S. PATENT DOCUMENTS

| | | | | | |
|---|---|---|---|---|---|
| D46,244 | S | | 8/1914 | Bush | |
| 1,710,778 | A | * | 4/1929 | Luhn | |
| 2,372,110 | A | * | 3/1945 | Noone | |
| 2,412,415 | A | * | 12/1946 | Navon | |
| 2,911,651 | A | * | 11/1959 | Nye et al. | 2/84 |
| 3,014,218 | A | * | 12/1961 | Smith | 2/87 |
| 3,323,136 | A | * | 6/1967 | Beck | 2/87 |
| 3,546,708 | A | * | 12/1970 | Chapman | 2/89 |
| 4,055,852 | A | | 11/1977 | Wallace | |
| 4,078,264 | A | * | 3/1978 | DeGennaro et al. | 2/88 |
| 4,313,229 | A | | 2/1982 | Villafane | |
| 4,370,755 | A | | 2/1983 | Crumby | |
| D294,535 | S | | 3/1988 | Stricklin | |
| 5,099,526 | A | | 3/1992 | Baena | |
| 5,101,512 | A | * | 4/1992 | Weinstein | 2/84 |
| 5,101,513 | A | * | 4/1992 | Bowers | 2/84 |

* cited by examiner

*Primary Examiner*—John J. Calvert
*Assistant Examiner*—Alissa L. Hoey
(74) *Attorney, Agent, or Firm*—Lackenbach Siegel LLC

(57) ABSTRACT

A cone-shaped outwear or disposable raingear of substantially waterproof material, having oppositely disposed front and back panels, with bottom edges, a bottom opening and sealed side edges terminating at said opening. The front panel having at least a partially perforated face opening disposed below where the side edges terminate at a top end, and at least two partially perforated openings disposed below the face opening. The method of fabricating the raincoat includes the steps of partially perforating a first elongated plastic sheet material with at least a partially perforated face opening and at least two partially perforated openings disposed below the face opening, and aligning another elongated plastic sheet material with the partially perforated plastic sheet material so that their elongated edges generally coincide with each other. Thereafter, sealing opposing side edges of the cone-shaped outerwear so that a plurality of connected triangular shaped raincoats are formed with front and backpanels secured together along the sealed opposing side edges; and cutting the sealed front and backpanels along a sealed side edge to form a triangular shaped cone-shaped outerwear with a bottom opening and closed side edges.

24 Claims, 6 Drawing Sheets

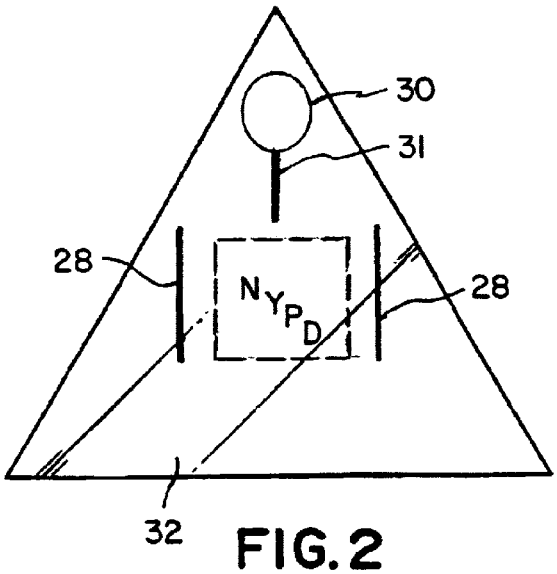
FIG. 2
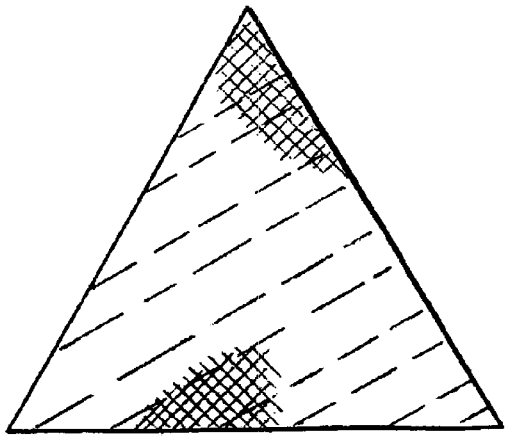
FIG. 4A
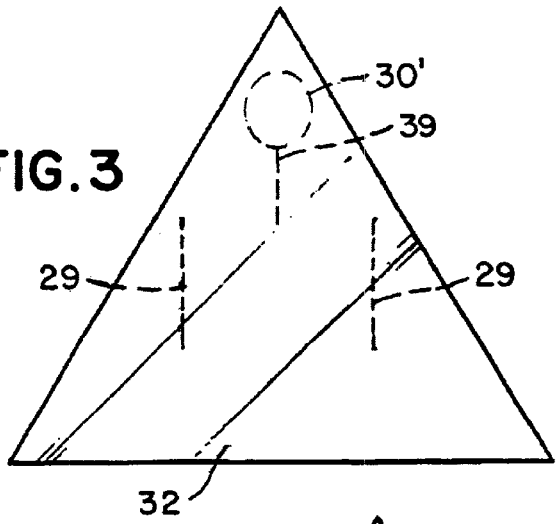
FIG. 3
FIG. 4
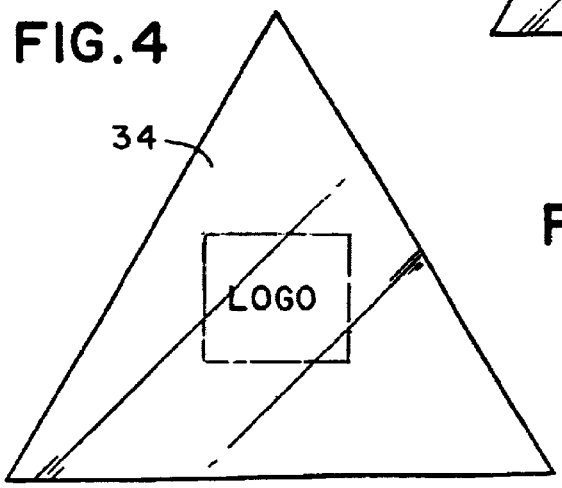
FIG. 4B
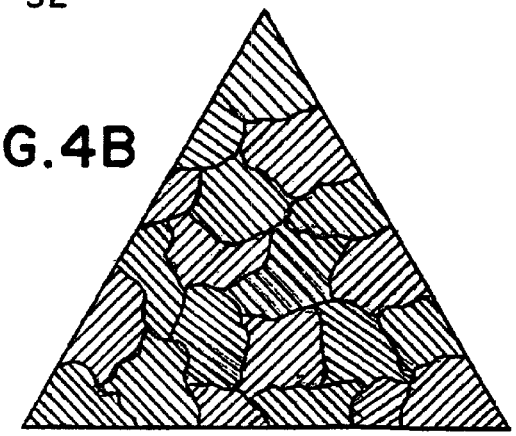

DISPOSABLE RAINWEAR

BACKGROUND OF THE INVENTION

This invention relates to rainwear, and more particularly to an inexpensive and disposable, waterproof protector or raincoat, especially suited for use in conditions where the "elements", such as rain or snow are unexpected or for use by workers and others who primarily are engaged in outdoor activities or working conditions, such as gardeners, contractors, builders, tourists, campers, police, postman and the like. In fact just about anyone would rather be inclined to have a "spare" disposable raincoat in their pocket rather than carrying around an umbrella all day long and/or losing same somewhere along one's busy day. In addition, the invention is suitable for use as "give-a-ways" or as a "premium" in connection with the marketing of any product; and it can be utilized at "summertime" outdoor concerts, or any other type of outdoor activity, paintball games, the Olympics or other like games, other sporting events or any type of outdoor events, such as where people are gathered en masse in very large numbers.

DESCRIPTION OF THE RELATED ART

Various raincoat designs are known, such as those disclosed in U.S. Pat. Nos. Des. 46,244 to Rush; Des. 294,535 to Stricklin; 4,313,229 to Villafane; 4,055,852 to Wallace; 4,370,755 to Crumby and 5,099,526 to Baena. However, all of these raincoat designs have one or more the following disadvantages: long open sides or front openings where rain, snow, etc. can enter the area protecting a user and thus wet the user's body; requires multiple parts or a multitude of sizes so as to fit all users; requires face and/or body straps or other tying strips which break or fail in use as the raincoat material is usually very thin and frail and generally easily torn or ripped if abused or handled roughly; is made from conventional plastic, garbage bags or lay flat tubing; precludes or restricts mobility of the arms; or are rather hot in use as no chest ventilation is employed nor large elongated arm holes or "slots" to minimize discomfort due to the use of plastic itself which is predominately the material of choice for such raingear due to its low cost and disposability.

SUMMARY OF THE INVENTION

The invention concerns outerwear or raingear in the form of a cone, made of a substantially waterproofed material, with opposing front and backpanels having bottom edges and a bottom opening and sealed side edges that terminate at the bottom opening. The front panel further having at least a partially perforated face opening disposed below where the side edges terminate at a top end, and having at least two partially perforated openings disposed below the face opening.

The invention also pertains to a process for manufacturing a disposable raincoat which includes the steps of partially perforating a first elongated plastic sheet material with at least a partially perforated face opening and at least two partially perforated openings disposed below the face opening, aligning another elongated plastic sheet material with the partially perforated plastic sheet material so that their elongated edges generally coincide with each other; and sealing opposing side edges of the cone-shaped outerwear so that a plurality of connected triangular shaped raincoats are formed with front and backpanels secured together along the sealed opposing side edges; and cutting the sealed front and back panels along a sealed side edge to form a triangular shaped cone-shaped outerwear with a bottom opening and closed side edges.

Lastly, the plastic disposable raingear of the invention can be dispensed, as desired, one at a time from a single continuous roll of "connected" identical raincoats, having a predetermined base width and two layers of plastic sheet material, and with perforations on one of said layers of plastic sheet material, so that the one layer forms with the other plastic layer oppositely disposed triangular shaped front and back panel sides of the raingear with sealed and perforated side edges, and with at least a partially perforated face opening and at least two partially perforated openings disposed below the face opening.

BRIEF DESCRIPTION OF THE DRAWINGS

FIG. 2 is a plan view of one embodiment of the front panel thereof, showing the three apertures referred to in the description of FIG. 1, with the topmost oval-shaped face aperture having an optional, downwardly extending centerline "cut" to facilitate air-flow into and out of the tent-like rainwear, and with an optional "logo" shown in phantom between the arm aperture or openings;

FIG. 3 is an alternate embodiment of the front panel, wherein the "three" apertures are only perforated (or "nicked") so that the face aperture and "arm slots" need to be "pushed or punched out" by the user prior to using such tent-like rainwear;

FIG. 4 is a plan view of the back or rear panel, which can be used with either of the front panels shown in FIGS. 2 and 3, and with an optional back or rear panel "logo" also shown in phantom;

FIG. 4A shows or represents another alternate panel (front or rear) of any color or even clear, but with diagonal reflective tape or luminescent strips or layers applied thereon or forming a part thereof;

FIG. 4B is yet another alternate panel (rear) and/or front panel (without showing the cutouts/perforations) with conventional camouflage, such as the randomly shaped brown and green areas which are shown therein lined for such colors;

DETAILED DESCRIPTION OF THE INVENTION

Figure 1:
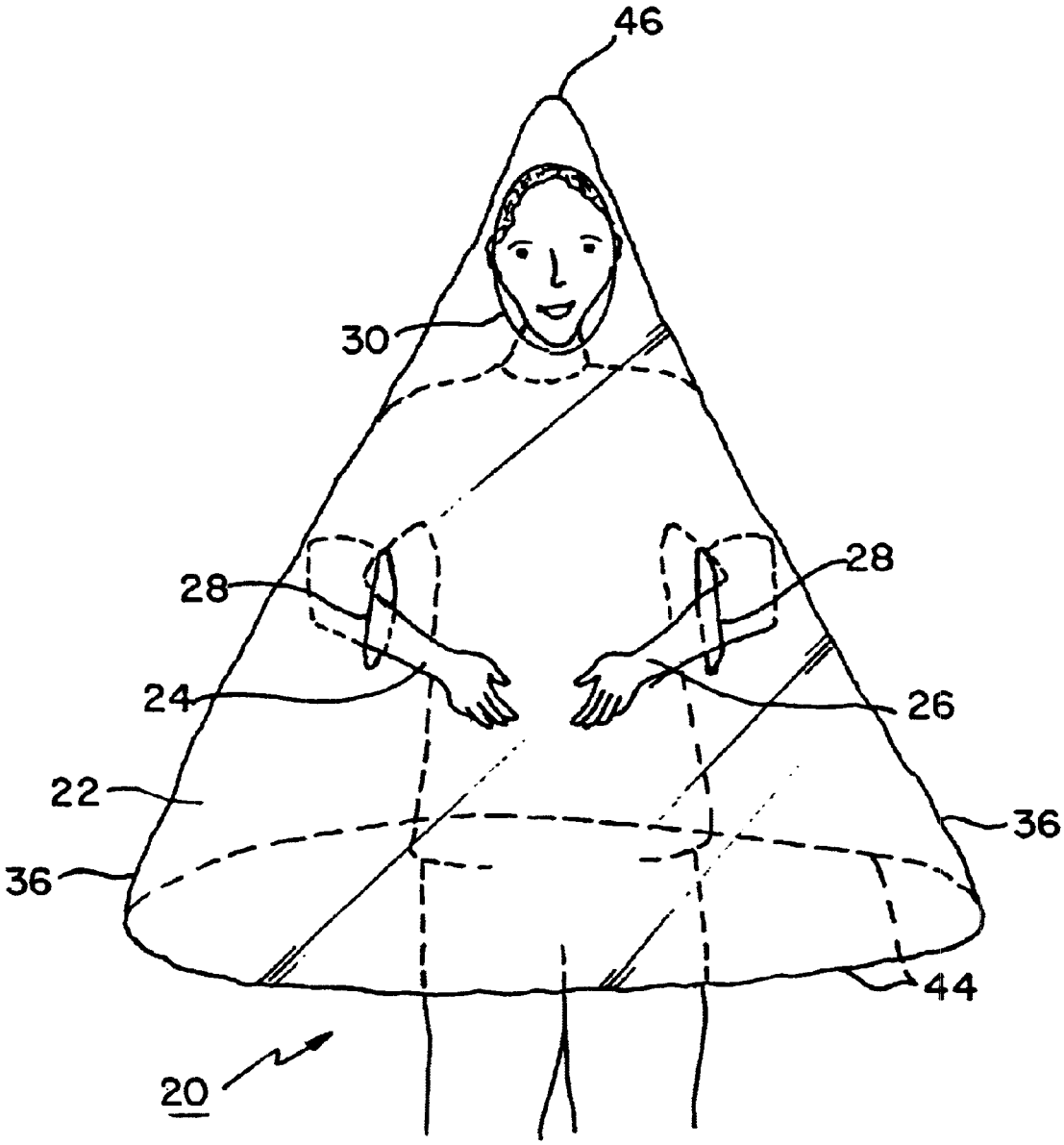
FIG. 1 is a front perspective view, of my tent-like rainwear as employed by a user, with the user's face and arms exposed through a topmost oval-shaped aperture and a pair of parallel elongated apertures.

Referring now to the drawings, and in particular to FIGS. 1–4A and 4B, there is shown a user 20 covered and protected by my disposable raingear or raincoat 22, which is preferably made from a pair of panels or from sheet material suitably dispensed from a pair of rolls. The sheet material is relatively thin and preferably of a plastic composition which is either waterproofed or has water repellancy or sufficient water-resistance to enable a user to use the raingear in inclement weather conditions. The user's arms 24, 26 extend from a pair of elongated apertures or openings 28, 29 or perforations, and the user's head protrudes from a face aperture or opening 30 (or optional perforated opening 30' or cut/slot 39) either openings 30 or 30' being preferably of oval configuration or shape, with all three openings or apertures in one of the triangular-shaped panels, namely front panel 32. The rear panel 34 is plain and has no openings or other apertures. The face aperture should have a vertical major axis and a minor horizontal axis. The hand/arm "openings" generally range in length from about 4 to about 16 inches, and preferably from about 8 to about 12 inches.

Figure 5:
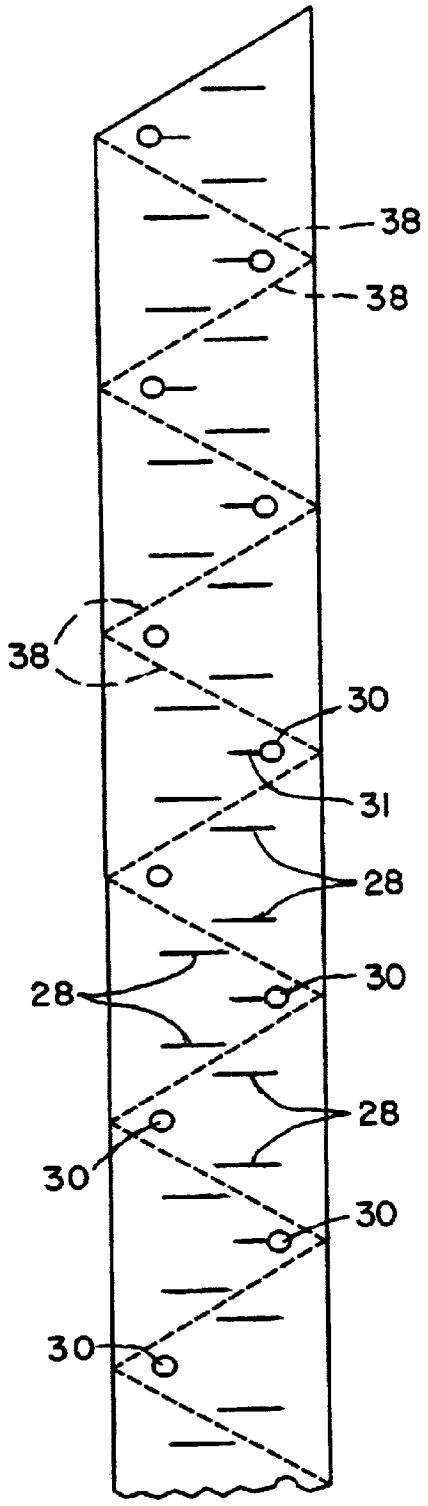
FIG. 5 is a diagramatic top plan view, of a web of material pre-perforated to provide both all three apertures in each of the plurality of side-by-side raincoats (with oppositely disposed face or head openings), and the opposing side seams sealed and/or fused either on and/or about the raincoat's pair of side seams.
Figure 6:
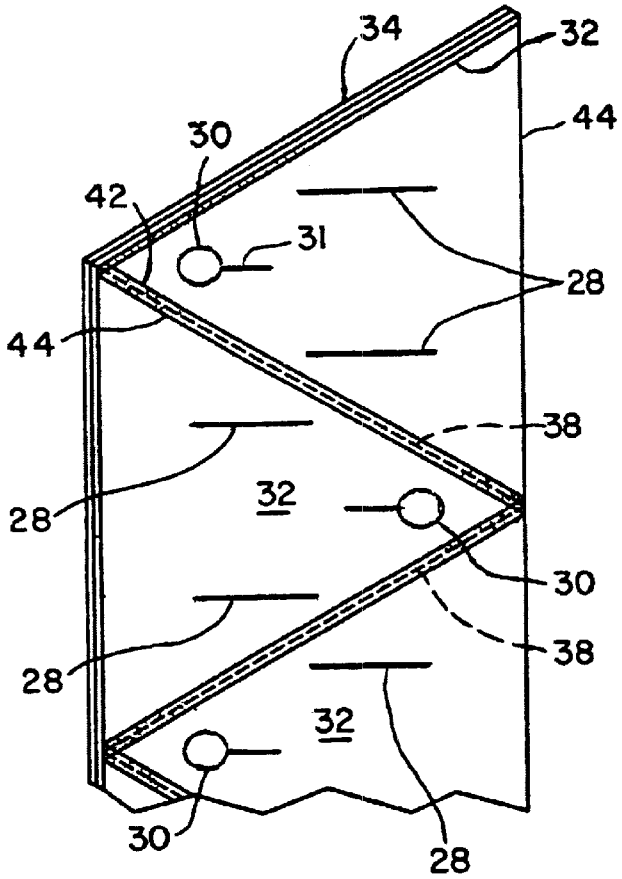
FIG. 6 is a greatly enlarged, perspective view, of the webbed material shown in FIG. 5, but with an underlying plain web layer of generally the same material which forms the back panels for the raincoats when the opposite side seams are pulled apart to form, in single fashion one at a time, a plurality of separated raincoats.
Figure 7:
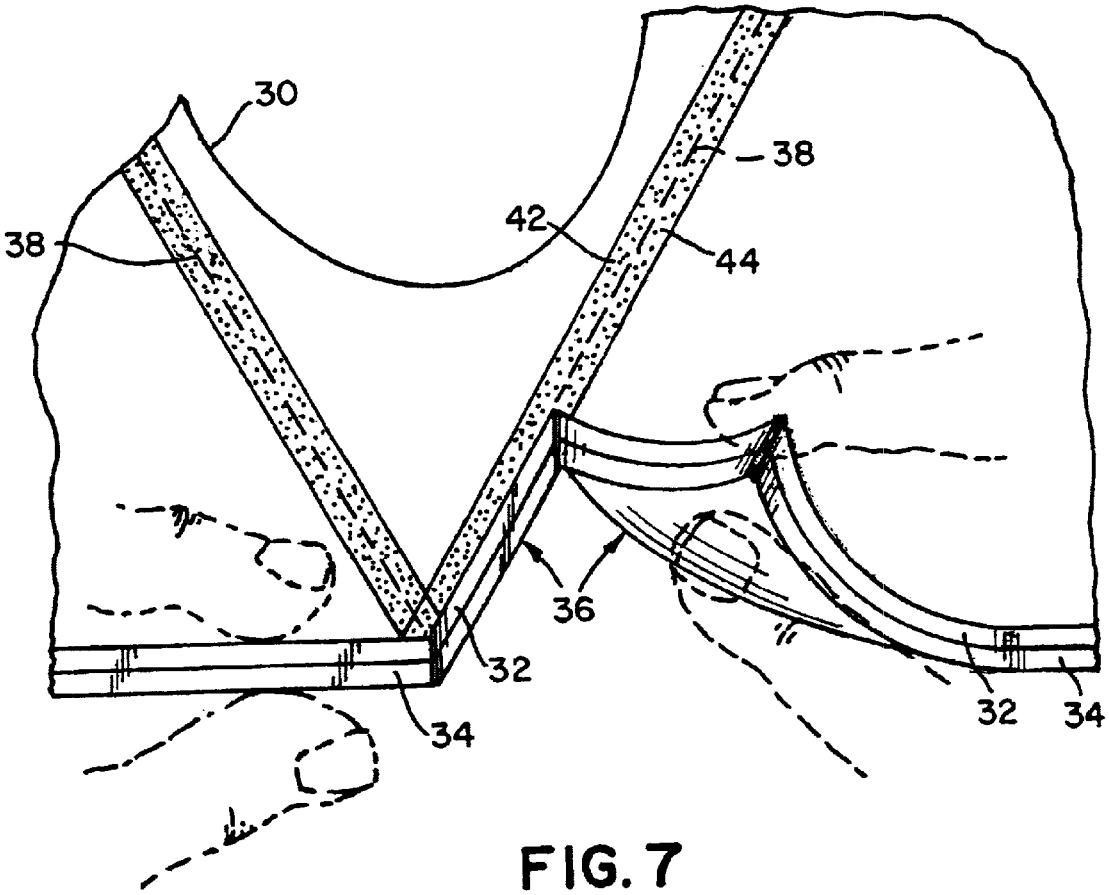
FIG. 7 is another greatly enlarged fragmentary view of the two layer webbed material shown in FIG. 6, but with one raincoat being separated from an adjacent raincoat with its face opening near the apex or top end of the disposable raincoat of the invention.
Figure 11:
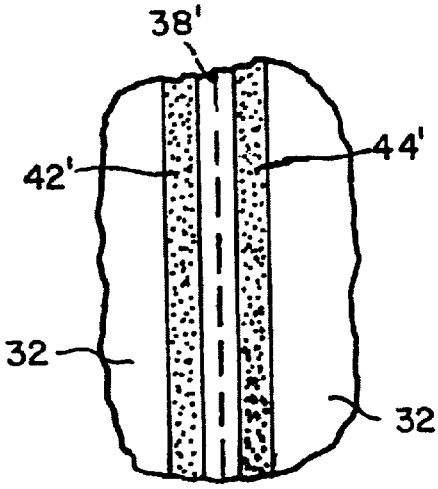
FIG. 11 is a greatly enlarged, fragamentary view of adjacent front panels with a pair of spaced side seams or sealed areas, and with a perforated edge between such two side seams.
Figure 8:
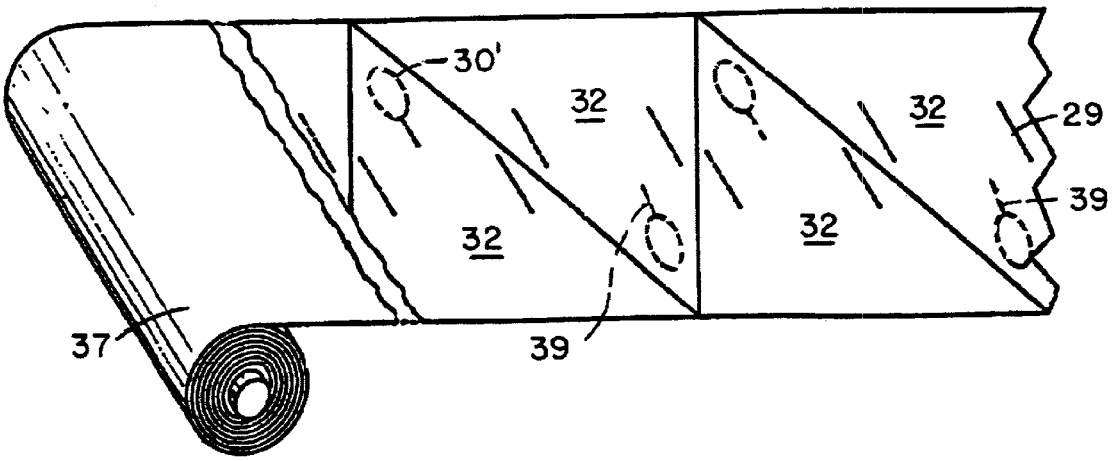
FIG. 8 shows in perspective a roll of the front panels where the three apertures have been prepunched out, and with an optional, downwardly extending centerline cut or opening which facilitates head entry and greater maneuverability of the body and particularly one's head in use during active work where the arms and face or head are exposed through the three apertures or openings (the opposite angled sides of the tent-like rainwear are shown herein for ease of illustration, but same are subsequently applied when the perforated sealed edges are generated or made separately or simultaneously together as will be further shown herein)
Figure 9:
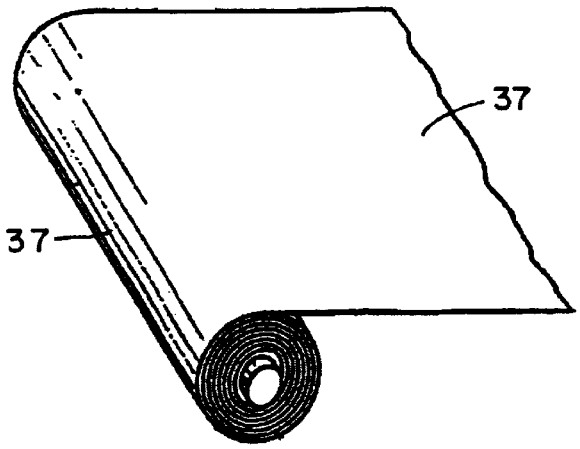
FIG. 9 shows in perspective a roll of the "rear panels" (which rear panels are made from such web material with opposing side seams sealed and/or fused either on and/or about the rainwear's pair of side seams when the two rolls of material are brought together and joined along their adjacently disposed side edges/seams.

The opposite side seam edges 36, as will be further described hereinafter, are formed with a center perforated line 38 (as best shown in FIGS. 5 to 7) and adjacently disposed thermosealed or ultrasonically sealed zones or areas 42, 44 on either side of the center perforated line 38 so that when the perforations are separated, sealed edges remain on both sides of the perforated cut, as is best shown in FIG. 7.

Figure 10:
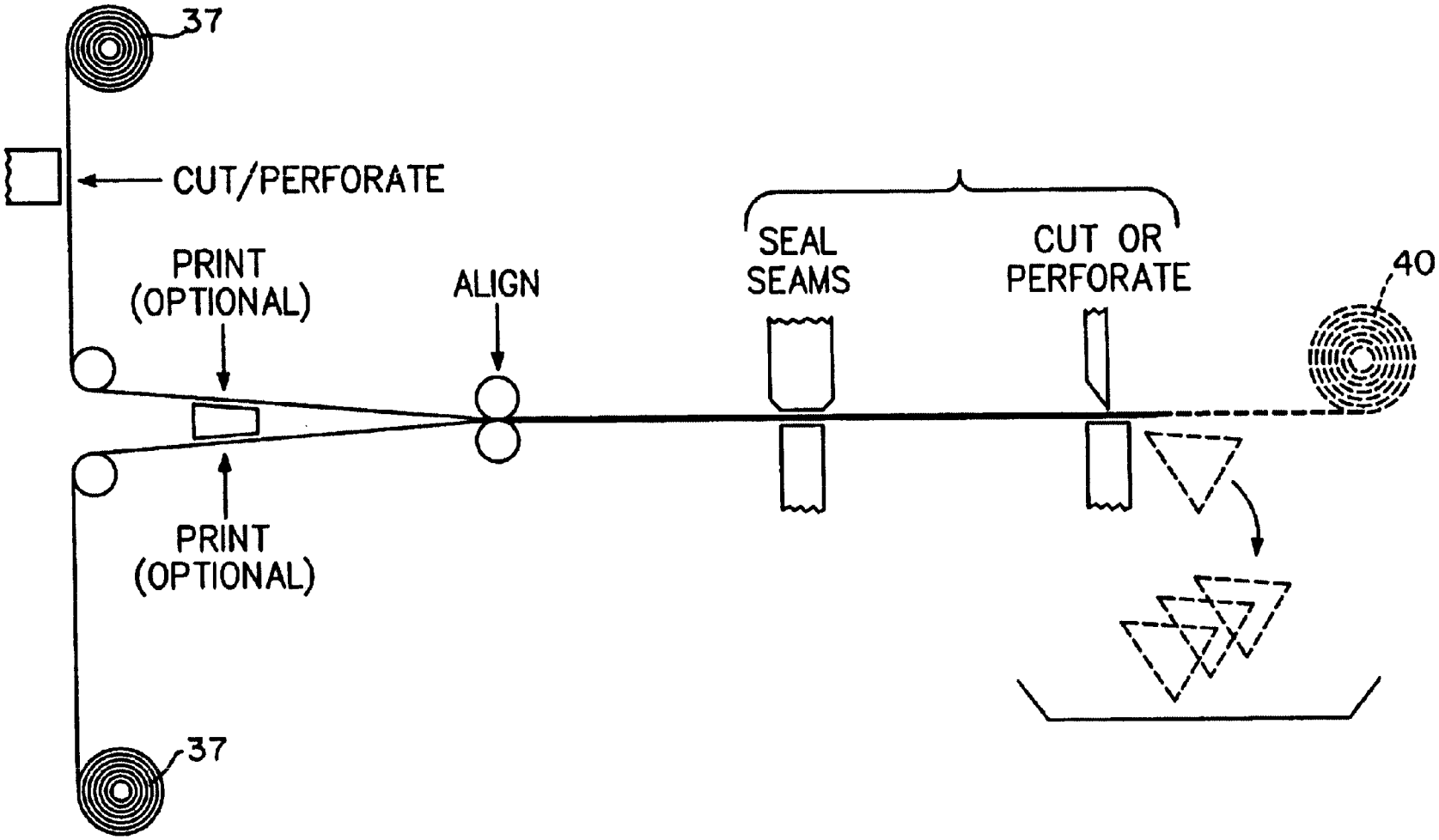
FIG. 10 is a diagramatic view of the process steps for forming the raincoats of the invention, and showing, among other steps, the front and rear panel rolls being joined together after the aligning step so as to form perforated/sealed areas or zones, or perforated seam lines and oppositely disposed seals on either side thereof for making an endless roll of my disposable rainwear or raincoats.

With the method of the invention, as best shown in FIGS. 8–11, rolls 37 of a suitable plastic sheet material (one of which is initially die-cut or perforated for the three apertures and optionally the parallel chest opening 39 as a first step is shown in FIG. 10). Then, if desired, the front and rear panels which are, respectively, formed from the top and bottom webbed material may be suitably imprinted with logos, company names, etc. Thereafter, a pair of or the two plastic web sheets are brought together and aligned, as shown in FIG. 10 where the webbed materials pass between a pair of rollers, and the sheets are then together joined by suitable means, such as thermosealing or by ultrasonic means, "welding" and the like. The cojoined sheets are then either simultaneously sealed and perforated or perforated between opposite side seam edges 36, previously made, so that one or more raincoats 22, may be individually removed from a thus formed roll 40 of the united web sheets one at a time or as a group or set of three, dozen, etc. as may be required.

In this connection, and as more particularly shown in FIGS. 5–7, the web sheets for the front panels (32) and rear 34 or back panels when brought together in alignment are then both perforated at their opposite side seam edges 36 and sealed on both sides thereof at 42 and 44 so that when each raincoat 22 is separated from roll 40, the side edges remain sealed from the bottom open edge 44 to the pointed end or top 46 of the raincoat 22. For ensuring a sealed end or top point 46, the side sealed zones are wide enough to sufficiently overlap near the top so that in effect the entire top zone or area is sealed off entirely leaving no possible opening where the opposing perforated side seam lines meet.

The plastic sheet material employed in the practice of the invention is generally a "soft" plastic and of a thickness which is reasonably flexible and permits in use mobility and maneuverability by the user with ease, but yet is durable and strong enough that it does not easily tear under normal "working" conditions. For most plastic materials, the sheet thickness is generally in the range of about one to about six mils, and more particularly about 2 mils to about 3 mils. Preferably, the plastic material may be clear or have color ("dyed"), and is recyclable so as to be readily disposable. Suitable plastic materials include mylar, cellophane, polyetheylene and other like plastic compositions, which are lightweight as compared to a rubberized film/material or a combined plastic/rubber composition. Generally, most plastic substances or materials that can be utilized are those that are capable of being formed into films. In addition, even recycled plastic, regradable plastic and/or other plastic including bio-degradable plastic materials may be employed in the practice of the invention. Moreover, while a clear plastic is preferable, opaque plastic or a colored or even a camouflage material is also suitable so long as it is sufficiently water-resistant or water-repellant. In fact, the material utilized may even be perforated with a plurality of tiny holes (which allow air, but not water to pass through) so that the raincoat is in effect "breathable".

Also, while a raincoat with about a 60 inch base or bottom edge and a height of about 54 inches from the bottom edge 44 to the top end point 46 is suitable for use by the average adult, the raincoat may be made in multiple sizes or patterns of like construction for classification as small, medium, large (regular adult) and extra large.

With the aforementioned "regular" sized raincoat, the tent-like device generally forms an isosceles triangle with a pair of 60° base angles and a 60° top end angle. Thus, with a 4½ foot or 54 inch roll of plastic sheet material an adult raincoat having a 60 inch base opening can easily be fabricated from a pair of such rolled stock or plastic sheet material.

Optionally, the raincoats if formed individually as shown optionally in phantom and being collected in the tray of FIG. 10, they can be individually folded and stacked in a suitable package or box (not shown) for ease of handling and dispensing rather than being dispensed from a rolled stock supply of the raincoats. It should also be appreciated that the peak or top portions of the tent-like raincoat of the invention forms in effect an integral hood for the user's head with the face opening being in effect like the front opening of a conventional hood of a jacket or other type outerwear embodying a hood. Other modifications of the disposable rain coat include those having reflective zones or striping, and/or those having either or both phosphoresence and luminescence elements which exhibit a "glow" in the dark and/or are cited when exposed to light that such raincoats having same are readily visible from a distance. Such elements or zones may be provided in the material itself or applied thereto as overlays or coatings.

The foregoing has described the preferred principles, embodiments and modes of operation of the present invention; however, the invention should not be construed as limited to the particular embodiments discussed. Instead, the above-described embodiments should be regarded as illustrative rather than restrictive, and it should be appreciated that variations, changes and equivalents may be made by others without departing from the scope of the present invention as defined by the following claims.

What is claimed is:

1. Rain gear comprising:

a cone-shaped outerwear of substantially waterproof material, having oppositely disposed front and back panels, with bottom edges, a bottom opening, and sealed side edges terminating at said opening;

said front panel having:

a first perforated area disposed below where said side edges terminate at a top end point, said first perforated area adapted to be removed from the front panel to provide a face opening, and at least two elongated perforations disposed below said first perforated area, said two elongated perforations adapted to be opened to provide apertures for the arms of the wearer.

2. The rain gear according to claim 1, wherein a third elongated perforation extends downwardly from said first removable area, said third elongated perforation adapted to be opened to form a chest opening.

3. The rain gear according to claim 2, wherein the three elongated perforations are generally parallel to each other, and wherein the at least two elongated perforations that are disposed below said first perforated area are disposed near said sealed side edges.

4. The rain gear according to claim 1, wherein said cone-shaped outerwear is in a form substantially resembling an isosceles triangle.

5. The rain gear according to claim 1, wherein said cone-shaped outerwear is in the form of a right triangle with a point at said top end where said side edges terminate, and with oppositely disposed 45° base angles where said bottom opening is joined at said sealed side edges.

6. The rain gear according to claim 1, wherein said material is a plastic film.

7. The rain gear of claim 6, wherein said material includes reflective zones/areas.

8. The rain gear of claim 6, wherein said material includes luminescence elements.

9. The rain great of claim 6, wherein said material includes phosphorescence elements.

10. The rain gear of claim 6, wherein said plastic includes both luminescence and phosphoresence elements.

11. The rain gear of claim 6, wherein said material is of any color.

12. The rain gear according to claim 1, wherein said plastic material is of a thickness ranging from about 1 mils to about 6 mils.

13. The rain gear according to claim 1, wherein said plastic material is of a thickness ranging from about 1 mils to about 3 mils.

14. The rain gear according to claim 1, wherein said plastic material is selected from the group consisting of thermoplastic materials and thermosetting materials.

15. The rain gear according to claim 14, wherein said selected plastic material is not colored.

16. The rain gear according to claim 14, wherein said selected plastic material is breathable.

17. The rain gear according to claim 14, wherein said selected plastic material has small openings which enable air to pass through, but which preclude water rain from seeping between said front and back panels of said outerwear.

18. The rain gear according to claim 1, wherein said at least two elongated perforations are generally parallel to each other, and are disposed near said sealed side edges.

19. The rain gear according to claim 1, wherein the length of each of said at least two elongated perforations is from about 4 inches to about 16 inches.

20. The rain gear according to claim 1, wherein the length of each of said at least two elongated perforations is from about 8 inches to about 12 inches.

21. A method of making a cone-shaped outerwear from substantially waterproof, elongated plastic sheets, comprising the steps of:

(i) partially perforating a first plastic sheet to form (a) a plurality of perforated areas adapted to be removed from the first plastic sheet to provide a plurality of face openings, and (b) multiple pairs of elongated perforations, each of said pairs of elongated perforations being disposed below a respective one or said plurality of perforated areas, (ii) aligning the second plastic sheet with the partially perforated first plastic sheet;

(iii) forming a plurality of connected triangular-shaped raincoats by joining the aligned plastic sheets with a plurality of perforated side seams;

(iv) forming individual raincoats each with a bottom opening and opposing side edges by cutting the plurality of connected triangular shaped raincoats along the sealed side edges.

22. The method of claim 21, including the steps of printing on at least one of said elongated plastic sheets a name and/or logo.

23. The method of claim 21, wherein steps (iii) and (iv) are done substantially simultaneously.

24. A roll of connected triangular-shaped raincoats comprising:

a perforated plastic sheet having a plurality of removable areas adapted to be removed from the perforated plastic sheet to provide a plurality of face openings, and multiple pairs of elongated perforations, each of said pairs of elongated perforations being disposed below a respective one or said plurality of removable areas, a second plastic sheet joined to the perforated plastic sheet by a plurality of perforated side seams, the perforated side seams defining individual triangular-shaped raincoats within the roll of connected triangular-shaped raincoats, wherein the perforated side seams are adapted so that the side seams of the individual raincoats remain sealed when each individual raincoat is separated from the roll.

* * * * *